US005127329A

United States Patent [19]

DeMoore et al.

[11] Patent Number: 5,127,329

[45] Date of Patent: Jul. 7, 1992

[54] VACUUM TRANSFER APPARATUS FOR ROTARY SHEET-FED PRINTING PRESSES

[75] Inventors: Howard W. DeMoore, Dallas; Howard C. Secor, Coppell, both of Tex.

[73] Assignee: Howard W. DeMoore, Dallas, Tex.

[21] Appl. No.: 630,308

[22] Filed: Dec. 18, 1990

[51] Int. Cl.[5] ..... B41F 13/02

[52] U.S. Cl. ..... 101/420; 101/231; 101/232; 101/217; 101/492; 101/480; 271/276; 271/277; 271/194

[58] Field of Search ..... 101/183, 231, 232, 217, 101/216, 215, 492, 480, 408, 420; 271/194, 276, 277, 82, 183

[56] References Cited

U.S. PATENT DOCUMENTS

| | | | |
|---|---|---|---|
| 2,138,178 | 11/1938 | Lang | 34/162 |
| 2,933,039 | 4/1960 | Claybourn | 101/183 |
| 3,076,492 | 2/1963 | Monks | 153/85 |
| 3,779,545 | 12/1973 | Schuhmann | 271/183 |
| 4,060,235 | 11/1977 | Weikel, Jr. | 271/174 |
| 4,092,021 | 5/1978 | Fletcher | 271/176 |
| 4,190,245 | 2/1980 | Brandes | 271/278 |
| 4,479,645 | 10/1984 | Pollich | 271/183 |
| 4,572,071 | 2/1986 | Cappel et al. | 101/183 |
| 4,688,784 | 8/1987 | Wirz | 271/195 |
| 4,722,276 | 2/1988 | Tyler | 101/419 |
| 5,004,221 | 4/1991 | Stark | 271/194 |
| 5,016,060 | 5/1991 | Arai | 355/312 |

FOREIGN PATENT DOCUMENTS

| | | | |
|---|---|---|---|
| 3345201 | 4/1986 | Fed. Rep. of Germany | 101/232 |
| 2434099 | 4/1980 | France | 101/232 |
| 192641 | 8/1989 | Japan | 271/194 |

*Primary Examiner*—Edgar S. Burr
*Assistant Examiner*—Eric P. Raciti
*Attorney, Agent, or Firm*—Dennis T. Griggs

[57] ABSTRACT

A vacuum transfer apparatus for use in a sheet fed rotary printing press for supporting the unprinted side of a freshly printed sheet as it is moved from the press impression cylinder along a transfer path to a further processing station of the press, the apparatus including a vacuum chamber supporting a plurality of rotatable elongated rollers arrayed in spaced side-by-side parallel relationship laterally across the transfer path, and a vacuum pump connected to the chamber for producing a pressure differential across the freshly printed sheet to draw the unprinted side of the sheet into engagement with the support rollers by drawing air into the vacuum chamber through the spaces between the rollers as the sheet is pulled along the transfer path so that the printed side of the sheet can not be marked or marred.

29 Claims, 6 Drawing Sheets

FIG. 3
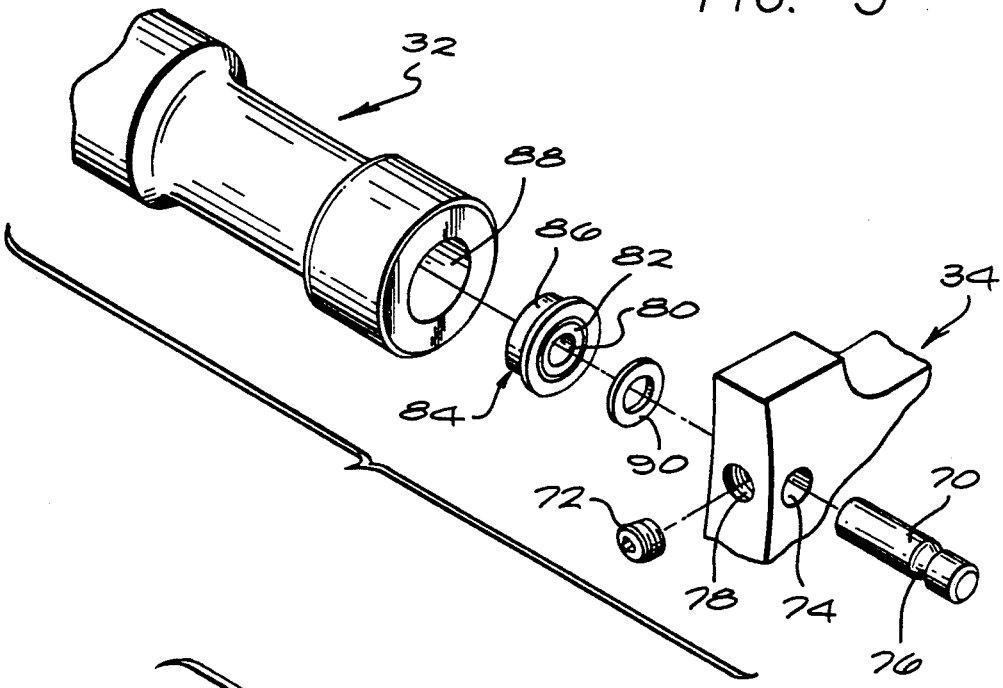
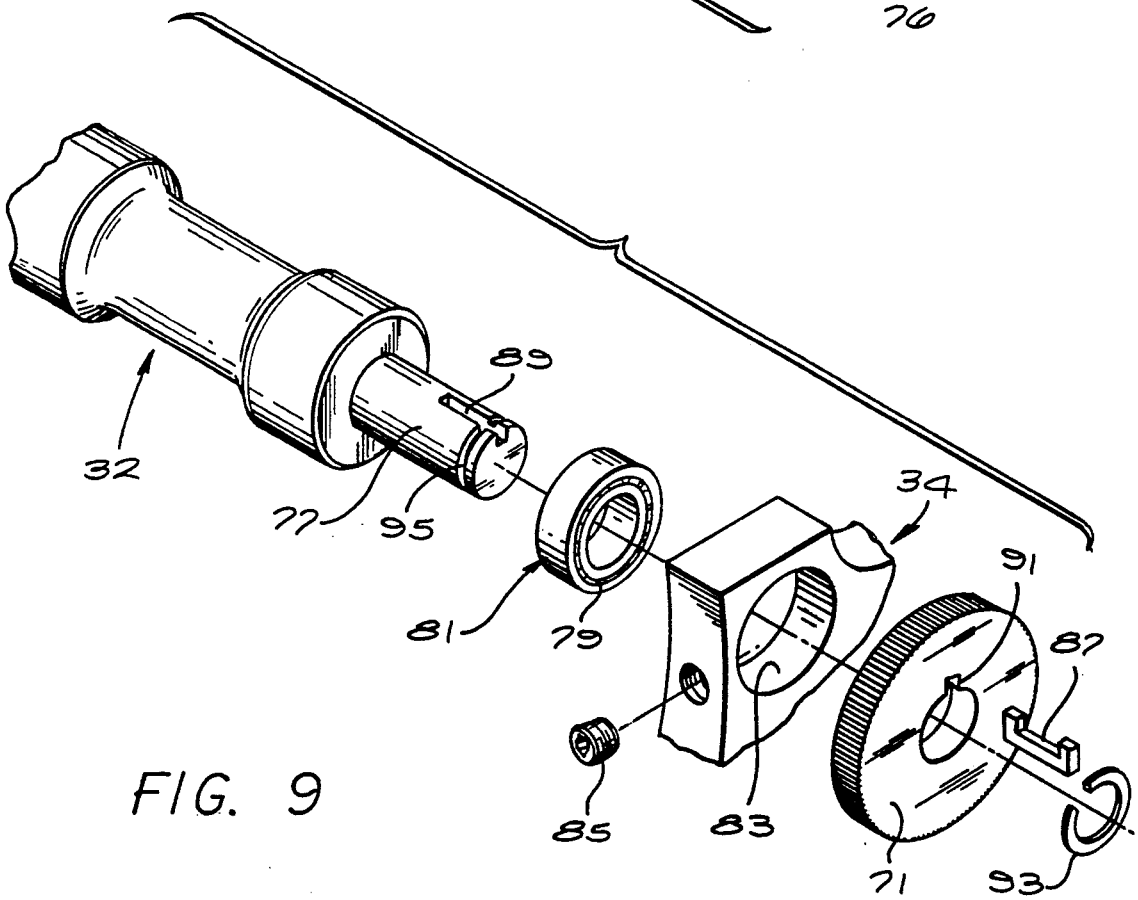
FIG. 9

VACUUM TRANSFER APPARATUS FOR ROTARY SHEET-FED PRINTING PRESSES

BACKGROUND OF THE INVENTION

This invention relates to rotary sheet-fed offset printing presses, and more particularly to a new and improved anti-marking vacuum transfer apparatus for supporting freshly printed sheets as they are moved between processing stations within the press.

During the movement of sheets being printed through a rotary sheet-fed offset printing press, it is conventional to employ a transfer or delivery system which engages and supports the wet ink side of the sheet as the sheet is moved between processing stations. Typically, a "transfer" system denotes an apparatus disposed between the several printing stations in the press and which functions to receive a freshly printed sheet from one impression cylinder and move the sheet to the next printing station for additional printing by a further impression cylinder. A "delivery" system typically denotes an apparatus which receives the freshly printed sheet from the last impression cylinder of the press, and delivers the sheet to the press delivery station, typically a sheet stacker. As used hereinafter, the term "transfer" is intended to include both apparatus used to transfer a sheet between printing stations of the press and an apparatus used for delivering the sheets to the press delivery stacking station.

One problem inherent in all transfer systems which engage and support the printed side of the sheet is that of marking and smearing the freshly applied ink. In the past, efforts to reduce sheet marking and marring have included employing apparatus such as those referred to in the trade as skeleton wheels and cylinders, and which have sheet engaging surfaces intended to minimize the area of sheet contact while still providing sheet support. Exemplary of such prior art devices are those discussed in the Background of the Invention of U.S. Pat. No. 3,791,644 issued Feb. 12, 1974 to Howard W. DeMoore entitled "SHEET HANDLING APPARATUS".

Another approach employs a transfer system having a cylinder with a specially prepared friction reducing support surface covered by a fabric cloth, known in the trade as a "net", and which is more fully described in U.S. Pat. No. 4,402,267 issued Sep. 6, 1983 to Howard W. DeMoore, entitled "METHOD AND APPARATUS FOR HANDLING PRINTED SHEET MATERIALS". That system, which is marketed under license by Printing Research, Inc. of Dallas, Tex. under its registered trademark "SUPER BLUE", actually maximizes the area of contact between the wet ink side of the sheet and the net covered surface of the transfer cylinder.

While the "SUPER BLUE" system has received wide spread industry acceptance and has enjoyed substantial commercial success, after prolonged use it is often necessary that the fabric net be replaced due to a build-up of ink on the net surface, or as a result of the net becoming excessively worn and/or torn. While the "SUPER BLUE" system allows the fabric net to be replaced relatively quickly, replacement of the net still requires that the press be shut down, thereby resulting in periodic press down time.

In many printing applications, only one side of the sheet receives ink from the blanket cylinders during each pass through the printing press. Applicants have found that in those situations where only one side of the sheet is to be printed, use of a transfer system which engages and supports the printed side of the sheet may be unnecessary and a transfer system can be used which engages and supports the nonprinted side of the sheet. For example, in non-perfector type printing presses, only one side of the sheet is printed during each pass through the press. In such presses, conventional transfer systems which support and engage the printed side of the sheet can be eliminated, and a transfer system which engages and supports only the nonprinted side of the sheet can be used.

In U.S. Pat. No. 2,933,039 issued Apr. 19, 1960 to Clayborn et al., entitled "SHEET TRANSFERRING MECHANISM", there is disclosed a transfer system for preventing sheet marking and which is intended to be a substitute for conventional transfer apparatus which engage and support the printed side of the sheet. That patent discloses a stationary curved sheet guide having a solid surface mounted adjacent to the path of the sheet transfer grippers and which supports the nonprinted side of a freshly printed sheet as it is pulled by the grippers from the impression cylinder. As discussed in that patent, provision is made for creating a negative pressure between the sheet and the solid surface of the sheet guide so that the sheet is drawn into engagement with the sheet guide as it is pulled by the grippers from the impression cylinder. Since only the nonprinted side of the sheet is engaged and supported by the sheet guide, marking and marring of the freshly printed surface cannot occur.

In U.S. Pat. No. 4,572,071 issued Feb. 25, 1986 to Cappel et al., entitled "DEVICE FOR GUIDING SHEET PRINTED ON ONE OR BOTH SIDES", there is disclosed an improvement over the foregoing Clayborn et al. patent, and which suggests employing a stationary curved sheet guide having an apertured solid support surface through which air can be drawn to create a negative pressure on the sheet, thereby to draw the nonprinted side of the sheet against the sheet guide. In this respect, this patent suggests that the sheet guide be formed as the surface of a plenum chamber coupled to a plurality of fans which can be selectively operated to either provide a negative pressure within the plenum chamber, or a positive pressure within the chamber such that the sheet can, respectively, be either drawn against the surface of the sheet guide in the case of single sided printing, or "floated" above the surface of the sheet guide in the case of two sided printing.

Applicants have found that with stationary sheet guide apparatus of the type disclosed in the Clayborn et al. and Cappel et al. patents, since the sheet is drawn onto and pulled against the substantially solid support surface of the sheet guide, the nonprinted side of the sheet may tend to be scratched and marred as it slides over the solid support surface. Further, use of stationary sheet guide apparatus of the types suggested by the Clayborn et al. and Cappel et al. patents may result in the sheet being pulled partially or fully from the transfer grippers due to the high frictional force created between the sheet and the supporting surface of the sheet guide, thereby resulting in sheet misalignment and destroyed registration for subsequent printing by the next printing unit.

As will become more apparent hereinafter, the present invention provides a new and improved transfer apparatus for supporting the nonprinted side of a sheet which solves the foregoing problems in a novel and unobvious manner.

SUMMARY OF THE INVENTION

The present invention provides a new and improved vacuum transfer apparatus for conveying freshly printed sheets between processing stations within a printing press by supporting the sheet on the nonprinted side in such a manner as to insure that the sheet is not scratched or marred, and precise sheet registration is maintained. The apparatus of the invention is relatively inexpensive to manufacture, highly reliable in use, and can be readily installed in existing presses as a replacement for traditional transfer apparatus, or as an alternative transfer system usable when only one sided sheet printing is being made.

In accordance with the present invention, the vacuum transfer apparatus includes an arcuate array of support rollers adapted to engage and support the nonprinted side of a freshly printed sheet as it is moved from the impression cylinder along the transfer path. The support rollers are mounted to a frame for rotation in side-by-side spaced relationship, and are arrayed to extend laterally across the transfer path. The frame which supports the rollers has substantially closed sides and forms a vacuum chamber with the rollers defining a face of the chamber adjacent the transfer path. The vacuum chamber formed by the frame and support rollers is coupled to a vacuum producing source such as a fan or pump for creating a negative pressure within the chamber to pull air into the chamber between the spaced rollers. As air is pulled through the space between the rollers into the vacuum chamber, the nonprinted side of a freshly printed sheet is drawn into engagement with the support rollers which rotate with the sheet to support and covey the sheet along the transfer path. In this manner, friction between the sheet and the support rollers is substantially eliminated, thereby preventing the possibility of scratching or marring the nonprinted side of the sheet, and insuring that the sheet is not pulled from the transfer grippers so as to destroy sheet registration.

Additionally, the support roller array is designed and dimensioned to provide a larger air flow volume adjacent the leading edge of the transfer apparatus to facilitate initial sheet redirection or "sheet break" as it leaves the impression cylinder, and the individual rollers adjacent the leading edge of the vacuum transfer device are contoured to permit the roller array to be mounted as closely as possible to the transfer path, thereby to eliminate minimize the possibility of sheet marking and misregistration, and to reduce the vacuum requirements of the system. In one embodiment, the rollers are mounted to the frame of the vacuum chamber for free rotation about their longitudinal axes, and in another embodiment, the rollers are positively driven about their axes to rotate at the same speed as that of the speed of travel of the sheet along the transfer path. In either case, the rollers support the sheet such that relative motion between the sheet and support surfaces of the rollers is minimized to prevent scratching or marring of the unprinted side of the sheets, and to prevent the sheet from being pulled out of the transfer grippers.

When installed in existing printing presses, the vacuum transfer apparatus of the invention can be used to supplement existing transfer systems, or to replace such systems. When used as a supplement to existing transfer systems, such as when installed in a perfector type press, the apparatus of the present invention can be selectively used to transfer freshly printed sheets which are to be printed on only one side during a single pass through the press, and can be inactivated when used during two-sided printed operations.

These and other features and advantages of the present invention will become more apparent from the following detailed description, taken in conjunction with the accompanying drawings which illustrate, by way of example, the principles of the invention.

BRIEF DESCRIPTION OF THE DRAWINGS

FIG. 3 is an enlarged fragmentary exploded perspective view of the mounting for a support roller and bearing assembly of the roller array used in one preferred embodiment of the vacuum transfer apparatus of FIG. 1;

FIG. 9 is an enlarged fragmentary perspective view showing the mounting for the support rollers of the embodiment of FIG. 8.

DETAILED DESCRIPTION OF THE PRESENTLY PREFERRED EMBODIMENT

Figure 1:
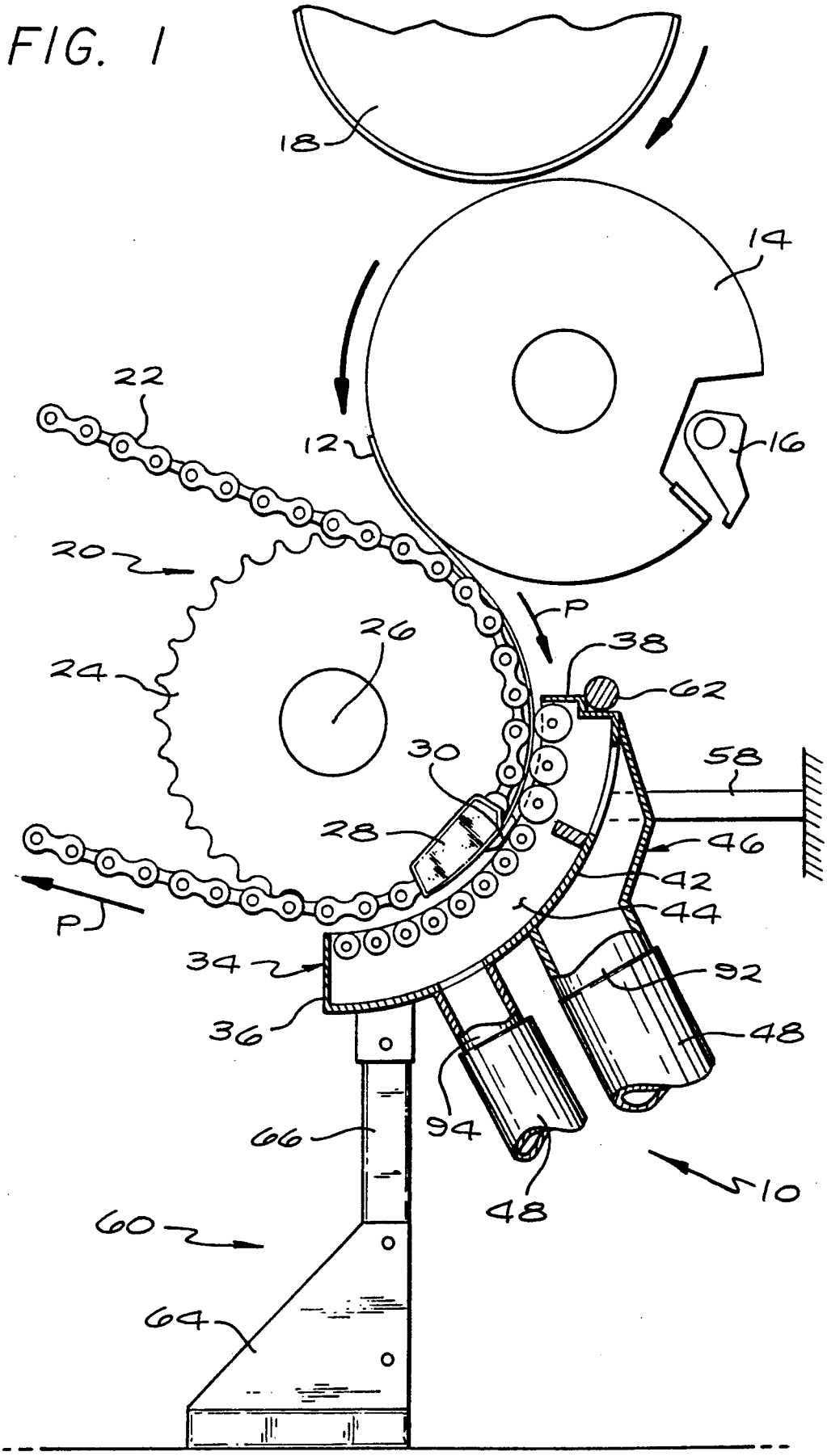
FIG. 1 is a fragmentary side elevational view schematically showing an anti-marking vacuum transfer apparatus constructed in accordance with the present invention and mounted in a transfer station of a Heidelberg 102 Speedmaster press.

As shown in the exemplary drawings, the present invention is embodied in a new and improved anti-marking vacuum transfer apparatus 10 primarily intended for use in a sheet fed, offset rotary printing press of conventional design, to engage and support the nonprinted side of a freshly printed sheet 12 as it is moved from an impression cylinder 14 of the press to a further processing station within the press. In this instance, sheets 12 to be printed are pulled by sheet grippers 16 attached to the impression cylinder 14 through the nip between the impression cylinder and a blanket cylinder 18 where ink is applied to one side of the sheet. After ink has been applied to the printed face of the sheet 12, a transfer conveyor 20 grips the leading edge of the sheet at the impression cylinder 14, and pulls the sheet from the impression cylinder, around the transfer apparatus 10, and then to a further processing station within the press, typically to another impression cylinder for further printing or to the press delivery stacker (not shown).

Herein, the transfer conveyor 20, which is also of conventional design, comprises a pair of endless chains 22 (only one of which is shown) trained about sprocket wheels 24 laterally disposed on each side of the press and centrally supported by a drive shaft 26. Extending laterally across the endless chains 22 at spaced intervals are sheet gripper assemblies 28 carrying a plurality of conventional sheet grippers 30 which operate to grip the leading edge of the sheet 12 at the impression cylinder 14, and move the sheet along the transfer path defined by the path of movement of the chain conveyors, the transfer path being herein generally designated by the arrows P. It should be noted that in conventional printing presses, the drive shaft 26 supporting the sprocket wheels 24 typically also functions to support many of the conventional transfer systems such as skeleton wheels, transfer cylinders, and the like. As will become more apparent hereinafter, the vacuum transfer apparatus 10 of the present invention can be positioned within the press with or without removing the conventional transfer apparatus then existing in the press.

In accordance with the present invention, the vacuum transfer apparatus 10 includes an arcuate array of support rollers 32 disposed along the transfer path P to engage and support the nonprinted side of a freshly printed sheet 12 in such a manner to insure that scratching and marring of the nonprinted side of the sheet does not occur, and that sheet registration is maintained. The vacuum transfer apparatus 10 of the invention is relatively inexpensive to manufacture, highly reliable in use, and can be readily installed in most existing presses with out requiring modification of existing transfer systems.

Figures 2, 8:
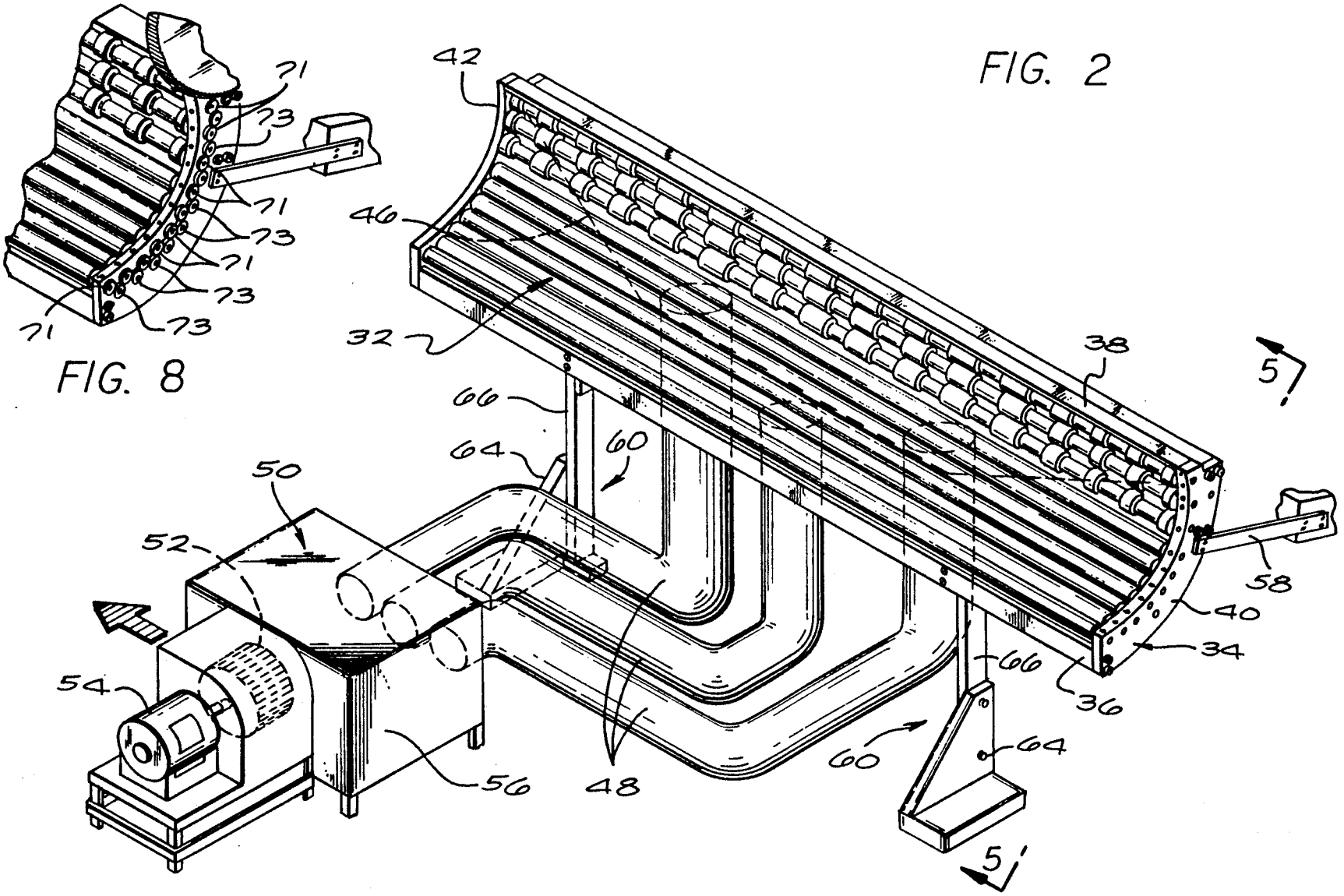
FIG. 2 is an enlarged, isolated perspective view of the vacuum transfer apparatus of FIG. 1 without the press components, and illustrating the apparatus coupled to a pump.
FIG. 8 is a fragmentary perspective view illustrating the support roller array used in an alternative embodiment for positively driving the rollers.

Toward the foregoing ends, the support rollers 32 are mounted for rotation to a frame, generally designated 34, and arrayed to extend side-by-side in spaced, parallel relation laterally across substantially the full width of the transfer path P. In this instance, the frame 34 is formed to create an internal vacuum chamber 44 defined by upper and lower end walls, 36 and 38, respectively, a pair of laterally spaced side walls 40, and a rear wall 42. Each of the side walls 40 has an arcuate shape corresponding to the arc of curvature of the transfer path P, and the support rollers 32 are mounted to the side walls opposite the rear wall 42 so that the rollers overlie the vacuum chamber 44 and form an arcuate path corresponding to that of the transfer path. Interconnected with the vacuum chamber 44 is a manifold 46 coupled by suitable air ducts 48 to a vacuum producing source 50, herein comprising a squirrel cage-type suction fan 52 driven by an induction motor 54. As shown in FIG. 2, a suction air plenum 56 is interposed between the fan 52 and the air ducts 48, such that when the fan is operated, air is pulled from the plenum by the fan, thereby creating a negative pressure within the plenum to pull air from the vacuum chamber 44 through the air ducts.

As a result of the creation of a negative or vacuum pressure within the vacuum chamber 44, air is drawn into the chamber through the spaces between the support rollers 32. This air flow creates a suction force along the transfer path P which will cause a sheet 12 being pulled from the impression cylinder 14 by the transfer conveyor 20 to be drawn into engagement with the support surfaces of the rollers 32. Preferably, the support rollers 32 are mounted to the side walls 40 such that the supporting surfaces of the rollers lie along the transfer path P or very sightly spaced radially outwardly therefrom (that is, toward the vacuum transfer apparatus 10) so that as a sheet 12 is supported and conveyed along the rollers, the grippers 30 can pass over the rollers and the sheet will not engage any other apparatus in the press, including any conventional transfer system components that may be present. Thus, the printed side of the sheet 12 will be maintained out of contact with any other apparatus, and can not possibly be marked, smeared or otherwise marred during the transfer.

In mounting the vacuum transfer apparatus 10 to the press, it is important to attempt to position the upper end of the frame 34 as close to the impression cylinder 14 as practically possible to insure a smooth transfer of sheets 12 from the impression cylinder to the support rollers 32. While different types of mountings may be required for different types of printing presses, herein the vacuum transfer apparatus 10 of the exemplary embodiment is illustrated mounted in a Heidelberg 102 Speedmaster press. As shown, the frame 34 is mounted to the press adjacent its upper end by a pair of mounting brackets 58 coupled to the press frame, and at its lower end by a pair of laterally spaced stanchions 60 supported by the floor on which the press stands. In this instance, the particular press shown has a rotating shaft 62 extending laterally across the press parallel with the impression cylinder 14, and which limits the location of the vacuum apparatus 10 within the press. The stanchions 60 herein include foundation blocks 64 coupled to the frame 34 by vertical legs 66 bolted to mounting blocks 68 secured to the bottom wall 42 of the frame.

In accordance with an important aspect of the present invention, the support rollers 32 are each mounted to the frame 34 for rotation so as to minimize any tendency of the sheets 12 to slide or skid over the roller support surfaces which could result in scratching or marring of the nonprinted side of the sheet. To achieve this end, in one presently preferred embodiment, the rollers 32 are mounted for free rotation (see FIGS. 2 and 3), and in another embodiment, the rollers are positively driven about their axes of rotation (see FIGS. 8 and 9). In this respect, due to the high volume of particulate material which is present in a press environment during use, such as paper dust, anti-offset powder, and other harmful materials, it is desirable that the rollers 32 be readily replaceable in the event of a roller malfunction.

Toward this end, in the presently preferred embodiment best seen in FIG. 3, each roller 32, which preferably is made of tubular or solid aluminum stock, is mounted for free rotation to the side walls 40 of the frame 34 by stub axles 70 removably secured to the side walls by set screws 72. Each stub axle 70 has an outer end portion which herein projects through a bore 74 formed in the side wall 40 of the frame 34, and is provided with an annular recess 76 into which the set screw 72 projects, a threaded opening 78 being provided in the side wall to intercept the bore. The inner end portion of the stub axle 70 extends into a central opening 80 formed through the inner race 82 of a sealed bearing 84. The outer race 86 of the bearing 84 is friction fit into an axial bore 88 formed in the end of the roller 32, and the mounting is completed by positioning a donut-shaped washer 90 between the bearing 84 and the side wall 40. With this arrangement, the roller 32 is free to rotate on the bearing 84 about the stub axle 70, and can be quickly and easily released for removal from the frame 34 simply by removing the set screws 72 and withdrawing the stub axles from the bearings through the bores 74.

In an alternative embodiment best seen in FIGS. 8 and 9, the rollers 32 may be mounted to the frame 34 to be positively driven at the same surface speed as the speed of the sheet 12 moving along the transfer path P so that no relative motion between the sheet and the support surface of the rollers can occur. In this instance, the rollers 32 have pinion gears 71 drivingly coupled to each other through idler gears 73 mounted to the side walls 40 of the frame 34, the initial pinion gear being driven by a suitable drive gear 75 coupled to the press, for example, coupled to the drive shaft of the impression cylinder 14. While any suitable drive source from the press can be used, what is important is to select suitable drive gear 75, idler gear 73, and pinion gear 71 ratios that will insure that the support rollers 32 each are driven at the same speed as the speed of travel of the sheet along the transfer path P.

To permit the driven rollers 32 to be releasably mounted to the frame 34, herein each roller includes an axle 77 fixed to the end of the roller and which extends through the inner race 79 of a sealed bearing 81 releasably retained in a bore 83 formed in the side wall 40, the bearing herein being retained in the bore by a removable set screw 85. Each pinion gear 71 is retained on the end of the axle 77 by a key 87 mounted in key-ways 89 and 91 formed, respectively, in the axle and pinion gear, and a C-shaped retainer 93 removably mounted in an annular groove 95 formed adjacent the end of the axle. Preferably, only one end of the roller array will include pinion gears 71, it being understood that the ends of each of the rollers 32 opposite the driver ends can be similarly mounted to the side walls 40 but will not include pinion gears.

To insure that the transfer of sheets 12 from the impression cylinder 14 to the vacuum transfer apparatus 10 is accomplished smoothly and in such a manner as to eliminate the possibility of the sheet coming into contact with other parts of the press, it is important that a sheet be quickly and smoothly brought into contact with the support rollers 32 as it is initially pulled from the impression cylinder by the transfer grippers 30. To achieve this result, the vacuum transfer apparatus 10 must rapidly change the direction of travel of the sheets 12 as each sheet leaves the surface of the impression cylinder 14. Moreover, this reversal of direction, referred in the trade as "sheet break", must be accomplished smoothly and uniformly to insure that the sheet is not pulled fully or partially out of the grippers of the transfer conveyor since movement of the sheet in the grippers will result in sheet misregistration.

To achieve these ends, the vacuum transfer apparatus 10 of the present invention includes means for providing a greater amount of air flow, and hence a greater suction force, along the transfer path P for the portion of the transfer apparatus adjacent the impression cylinder 14 than that for the portion of the apparatus further along the transfer path P. By providing a larger air flow into the vacuum chamber 44 in the portion of the vacuum transfer apparatus 10 adjacent the impression cylinder 14, the leading edge of a sheet 12 being transferred can be caused to be pulled rapidly against the support rollers 32, thereby to effect a rapid sheet break. As the sheet 12 progresses further along the transfer path P, less air flow is required to maintain the sheet in engagement with the support rollers 32, and the sheet will remain engaged with the rollers yet experience a lower resistance to forward movement due to the lower level of suction force exerted by the vacuum transfer apparatus 10.

Figure 4:
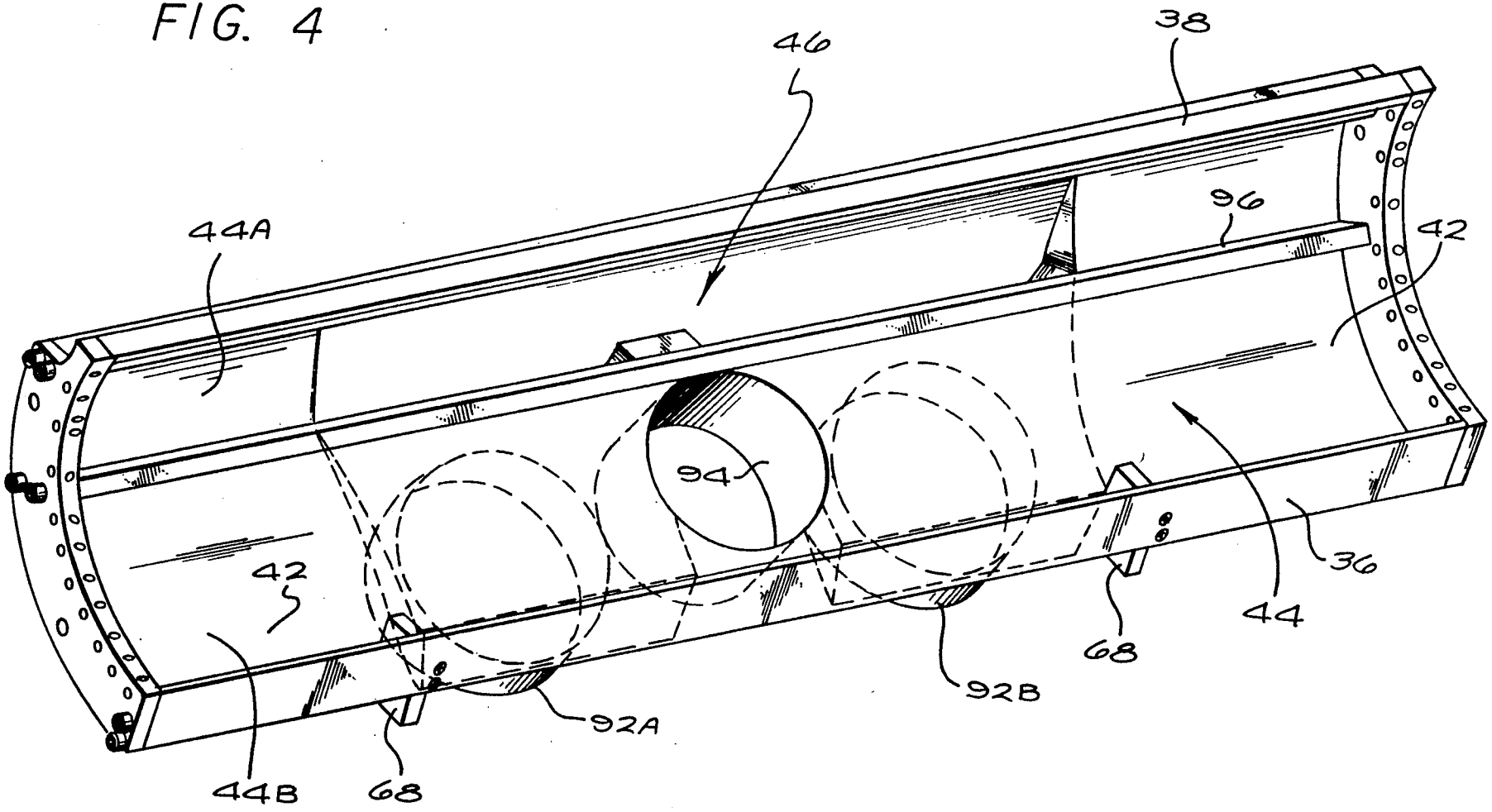
FIG. 4 is an enlarged perspective view of the frame forming a vacuum chamber of the vacuum transfer apparatus of FIG. 1, and shown with the roller array removed for clarity of illustration.

To achieve the desired air flow differential, the presently preferred embodiments of the invention employ the combined effects achieved by forming a partition in the vacuum chamber 44, and increasing the effective area between the support rollers 32 disposed adjacent the impression cylinder 14. As best can be seen in FIG. 4, a divider wall 96 is secured to the rear wall 42 to extend laterally across the inside of the vacuum chamber 44, and separates the chamber into upper and lower portions, designated 44A and 44B, respectively. As shown, the upper chamber portion 44A comprises approximately one third the total vacuum chamber area, while the lower portion 44B constitutes the remaining approximately two thirds. The manifold 46 herein is formed to provide three air openings into the vacuum chamber 44, two of which, designated by reference numerals 92A and 92B, communicate with the chamber upper portion 44A, and the third, designated 94, communicating with the chamber lower portion 44B. In this manner, a substantially greater air flow through the vacuum chamber upper portion 44A can be accommodated than that through the chamber lower portion 44B, thereby substantially increasing the suction force exerted on a sheet 12 as it is initially pulled onto the vacuum transfer apparatus 10.

To provide a greater air flow area along the transfer path P between support rollers 32 adjacent the impression cylinder 14, it is possible merely to space the support rollers in this area further apart along the side wall 40 of the frame 34. However, it has been found that superior results can be achieved by forming the initial support rollers 32 overlying the vacuum chamber upper portion 44A to have an effective diameter larger than the remaining support rollers, and to form the roller support surfaces to have a contoured shape to create areas of roller separation which are enlarged. Formation of the initial support rollers 32 in this manner insures that the sheets 12 being transferred will have adequate support and not be drawn or deflected into the space between the rollers, and permits the initial rollers to be mounted closer to the transfer path P than would otherwise be permitted, this further aiding in a smooth and uniform transfer of sheets from the impression cylinder 14 to the vacuum transfer apparatus 10.

Figure 5:
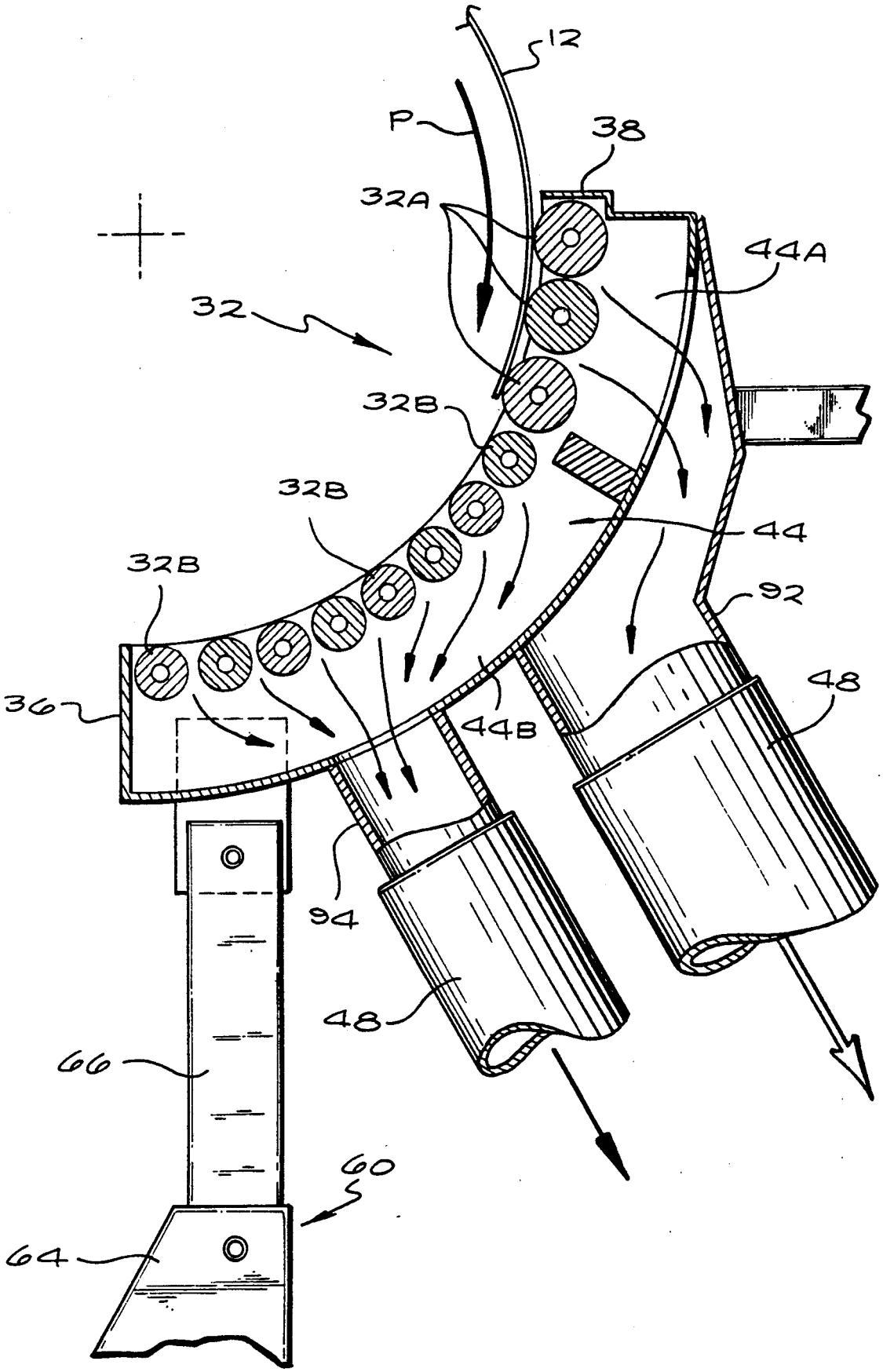
FIG. 5 is an enlarged sectional view taken substantially along the line 5—5 of FIG. 2.
Figure 6:
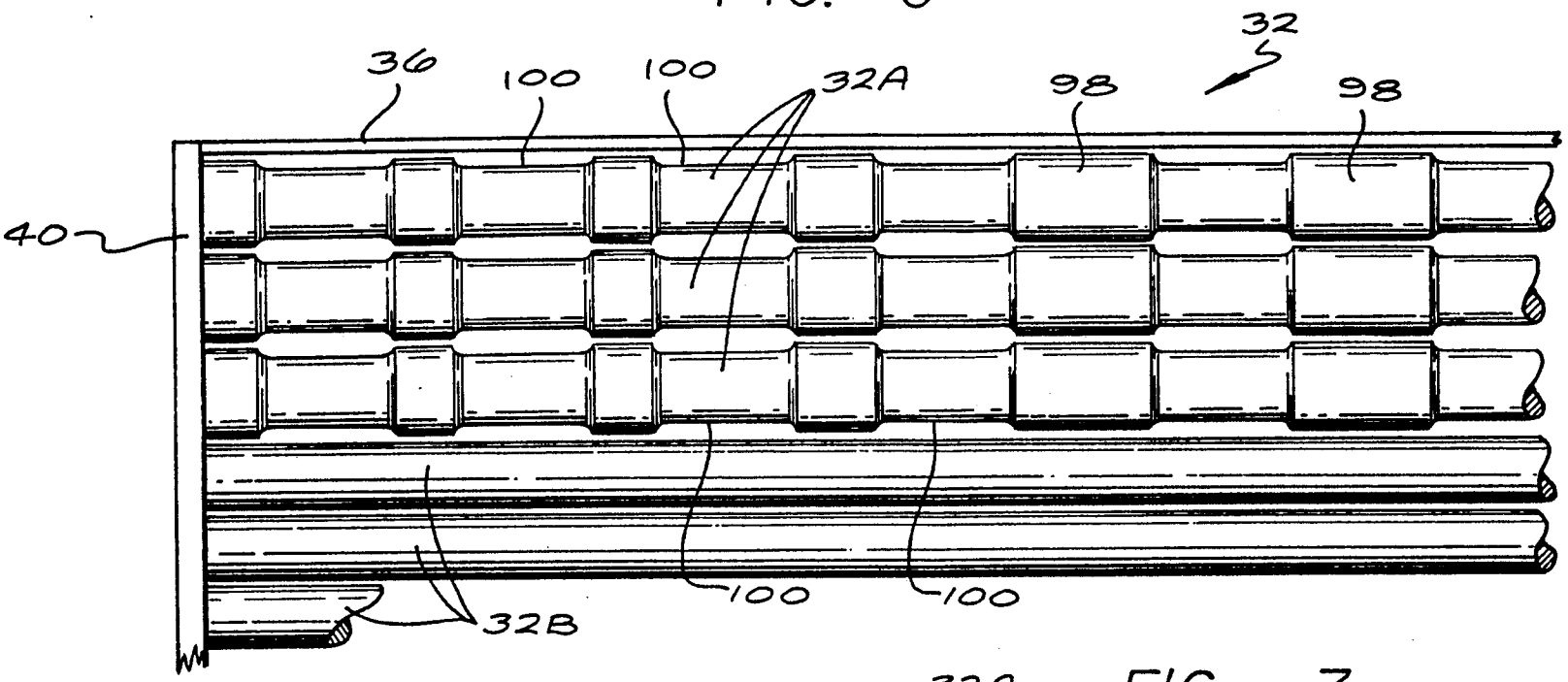
FIG. 6 is a fragmentary plan view of the roller array of the vacuum transfer apparatus shown in FIG. 2 with roller spacing dimensions of the exemplary embodiment added.
Figure 7:
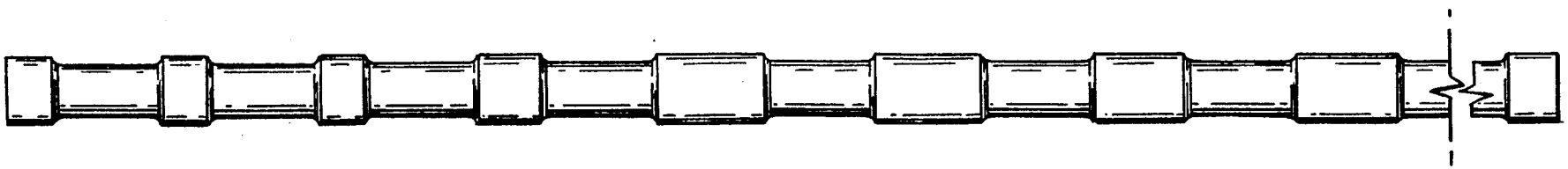
FIG. 7 is an isolated plan view of a large diameter roller of the roller array used in the vacuum transfer apparatus of FIG. 1, and showing the roller dimensions of the exemplary embodiment.

With primary reference to FIGS. 5 and 6, the array of support rollers 32 herein includes three initial rollers, designated 32A, of relatively larger diameter disposed to overlie the vacuum chamber upper portion 44A, and eight rollers of relatively smaller diameter, designated 32B, overlying the remainder of the vacuum chamber 44. In the exemplary embodiment, it has been found that with rollers 32 having a length of 40 inches, satisfactory results can be achieved by using a 1/16 inch spacing between each support roller, and large diameter rollers 32A having a maximum diameter of one inch with small diameter rollers 32B having a $\frac{3}{4}$ inch diameter. Preferably, the top wall 38 and the bottom wall 36 of the frame 34 are also formed to provide a 1/16 inch gap with the adjacent roller 32 so that the total area of the vacuum transfer apparatus 10 defined along the transfer path P is approximately 41 inches wide by $9\frac{3}{4}$ inches long, or a total of approximately $399\frac{3}{4}$ square inches. Since the vacuum chamber upper portion 44A is approximately one third the total area of the vacuum chamber 44 along the transfer path P, the area of the upper portion is approximately 133¼ square inches, and that of the vacuum chamber lower portion 44B is approximately 266½ square inches.

To provide an increased air flow area between the large diameter rollers 32A, the sheet support surface, designated 98, is contoured by forming areas of reduced diameter along the length of the roller, preferably by spaced recesses 100 formed between areas of full diameter. In this instance, the recesses 100 are formed in each large diameter roller 32A so that the roller diameter is ¾ inch at the recess, thereby providing an effective air inlet increase between adjacent recesses of the large diameter rollers of ¼ inch.

Provision of recesses 100 also permits the large diameter rollers 32A to be located closer to the transfer path P since the recesses permit the grippers 30 of the transfer conveyor 20 to pass below the support surface 98 of the rollers. Typically, the grippers 30 of a transfer conveyor 20 project approximately ⅛ inch beyond the gripper chain 22 in the direction radially outwardly with respect to the axis of the drive shaft 26 of the sprocket wheels 24. By locating the recesses 100 along the large diameter rollers 32A to coincide with the locations of the grippers 30, the grippers can pass freely through the recesses. Accordingly, the support surface portions 98 of the large diameter rollers 32A can be positioned to be substantially tangent to the true transfer path P, thereby providing a more smooth and uniform transition for the sheet 12 as it initially engages the vacuum transfer apparatus 10.

In the exemplary embodiments, the recesses 100 are each approximately 1-9/16 inch wide, but are not uniformly spaced along the large diameter rollers 32A. Rather, the location of the recesses 100 has been selected to coincide with the location of the grippers 30 found on the transfer conveyor 20 of the Heidelberg 102 Speedmaster press. In that particular type of press, the grippers 30 are spaced more closely together along the gripper bars 28 from the mid point laterally outwardly toward the ends at the chains 22 so that the recesses 100 must be similarly spaced to permit the grippers 30 to travel past the large diameter rollers 32A. With the recesses 100 dimensioned and located as shown in FIG. 6, the total effective air inlet area along the transfer path P defined by the larger diameter rollers 32A overlying the vacuum chamber upper portion 44A is approximately 27.8 square inches, and that defined by the smaller diameter rollers 32B overlying the vacuum chamber lower portion 44B is approximately 20.5 square inches. Thus, considering that the vacuum chamber upper portion 44A is one third the area of the overall vacuum chamber 44 and that there are two manifold openings 92A and 92B to the upper portion, the volume of air flow into the upper chamber is substantially greater, herein approximately twice that of the volume air flow into the vacuum chamber lower portion 44B which has only one manifold opening 94. With this relationship, it has been found that the sheet 12 will rapidly transfer smoothly and uniformly to the vacuum transfer apparatus 10, and will not be pulled from the grippers so as to destroy registration.

While the foregoing specific dimensions have been set forth for the exemplary embodiments shown in the drawings, it should be appreciated that other types of presses may require that the spacing and width of the recesses 100 be altered to suit the particular press. It is important to note that in selecting the particular spacing and width of the recesses 100, the effective air inlet area into the vacuum chamber upper portion 44A should be made to have approximately the same or greater effective area as that of the vacuum chamber lower portion 44B so that the air flow volume through the upper portion is substantially greater, preferably approximately twice that of the air flow volume through the lower portion. This will insure that the sheet 12 will be smoothly and uniformly drawn rapidly onto the vacuum transfer apparatus 10 as it is initially pulled from the impression cylinder 14 so that the printed side of the sheet can not contact any other apparatus in the press.

Moreover, while the exemplary embodiments have been presented in the context of a press having a transfer conveyor 20 employing chains 22 and gripper bars 28, the vacuum transfer apparatus 10 can equally be used with presses having other types of transfer conveyors since the vacuum transfer apparatus 10 of the invention will prevent the wet inked side of a sheet 12 from coming into contact with other press apparatus such as transfer wheels and cylinders. Thus, when used for example in a perfecting type press, the vacuum transfer apparatus 10 can be installed to supplement the existing transfer system without requiring removal of the existing transfer system. In such a case, the vacuum transfer apparatus 10 can be used when ever one sided sheet printing is to be done, and than deactivated when the press is used in the perfector mode for two sided sheet printing.

Further, it should be apparent that the principles of the present invention can be adopted for use in various types of rotary sheet fed presses, and that one or more vacuum transfer apparatus can be used in such presses in the transfer or delivery station or both. Moreover, while the foregoing discussion has been directed to the use of a plurality of support rollers, in very small rotary sheet fed presses it may be possible to employ the principles of the invention with only a single rotatably mounted support roller with the air flow into the vacuum chamber being around the roller through the spaces between the roller and the supporting frame of the vacuum chamber.

Those skilled in the art will appreciate that a variety of changes and modifications to the present invention can be made without departing from the spirit and scope of the invention as defined by the appended claims.

We claim:

1. In combination with a rotary sheet fed off-set printing press including a plurality of spaced processing stations each interconnected by a sheet transfer means for transferring sheets downstream along a transfer path from one processing station to the next, said processing stations including at least one upstream sheet printing station and a downstream sheet delivery station with each printing station having a blanket cylinder and an impression cylinder extending laterally within the press and arranged to apply wet ink to one side of a sheet moving downstream through the press, at least one of said sheet transfer means including a transfer conveyor having means for gripping and pulling a freshly printed sheet from the impression cylinder and moving said sheet downstream along said transfer path to the next processing station of the press, a vacuum transfer apparatus comprising:

a frame defining an upwardly open sided vacuum chamber having a leading end and a trailing end and defining therebetween an upstream chamber portion and a downstream chamber portion, said frame being disposed to extend laterally across said transfer path below said transfer conveyor with said leading end closely adjacent said impression cylinder;

a plurality of elongated generally cylindrical support rollers rotatably mounted to said frame overlying said upwardly open side of said vacuum chamber between said leading and trailing ends and arrayed in closely spaced side-by-side relation with adjacent sides of said rollers defining therebetween air inlet spaces to said vacuum chamber;

means communicating with said vacuum chamber for creating a negative pressure within said chamber to cause air to flow through said air inlet spaces between said rollers into said chamber for drawing the unprinted side of a sheet being moved by said transfer conveyor along said transfer path into engagement with said support rollers; and means for producing a differential air flow into said vacuum chamber between said leading and trailing ends by causing a substantially greater volume of air flow into said upstream chamber portion than the air flow into said downstream chamber portion, whereby said differential air flow causes said sheet to be drawn more firmly into engagement with said rollers overlying said upstream chamber portion than into engagement with said rollers overlying said downstream chamber portion.

2. A vacuum transfer apparatus as set forth in claim 1 wherein said means for producing said differential air flow includes means providing a substantially greater air inlet space between said support rollers overlying said upstream chamber portion of said vacuum chamber than the air inlet space defined between said support rollers overlying said downstream chamber portion.

3. A vacuum transfer apparatus as set forth in claim 2 wherein said support rollers include at least one roller having an enlarged diameter, said at least one roller overlying said upstream chamber portion of said vacuum chamber.

4. A vacuum transfer apparatus as set forth in claim 3 wherein said greater air flow spacing is formed by annular recesses spaced along the length of said at least one roller.

5. A vacuum transfer apparatus as set forth in claim 4 wherein said annular recesses are formed to provide approximately twice the air flow into said upstream chamber portion of said vacuum chamber than that into said downstream chamber portion of said vacuum chamber.

6. A vacuum transfer apparatus as set forth in claim 5 wherein said means for creating said negative pressure includes a vacuum producing pump coupled in flow communication with said vacuum chamber.

7. A vacuum transfer apparatus as set forth in claim 6 wherein each of said support rollers is mounted to said frame for free rotation about its longitudinal axis.

8. A vacuum transfer apparatus as set forth in claim 7 wherein each of said support rollers is mounted to said frame by bearings and axles.

9. A vacuum transfer apparatus as set forth in claim 6 including means for rotatably driving said support rollers in timed relation with the downstream movement of said sheet along said transfer path.

10. A vacuum transfer apparatus as set forth in claim 4 wherein said at least one roller comprises three such rollers, and said annular recesses are formed to provide approximately twice the air flow into said upstream chamber portion of said vacuum chamber than the air flow into said downstream chamber portion of said vacuum chamber.

11. A vacuum chamber apparatus as set forth in claim 10 wherein the minimum spacing between each support roller of said array is approximately 1/16 inch.

12. A vacuum transfer apparatus as set forth in claim 2 wherein said means for producing said differential air flow comprises providing annular recesses in the surfaces of said support rollers overlying said upstream chamber portion of said vacuum chamber.

13. A vacuum transfer apparatus as set forth in claim 12 wherein said greater air inlet space is formed to produce approximately twice the air flow into said upstream chamber portion than that into said downstream chamber portion of said vacuum chamber.

14. A vacuum transfer apparatus as set forth in claim 13 wherein each of said support rollers is mounted to said frame for free rotation about its longitudinal axis.

15. A vacuum transfer apparatus as set forth in claim 13 including means for rotatably driving said support rollers in timed relation with the downstream movement of said sheet along said transfer path.

16. A vacuum transfer apparatus as set forth in claim 15 wherein said substantially greater air inlet space is formed by annular recesses provided at spaced intervals along the length of said at least one roller.

17. A vacuum transfer apparatus as set forth in claim 1 including means for segmenting said vacuum chamber below said rollers into said upstream portion and said downstream portion, said segmented upstream chamber portion having a substantially smaller chamber area than the area of said segmented downstream chamber portion.

18. In combination with a rotary sheet fed off-set printing press including a plurality of spaced processing stations each interconnected by a sheet transfer means for transferring sheets along a transfer path extending downstream from one processing station to the next, said processing stations including at least one upstream sheet printing station and a downstream sheet delivery station with each printing station having a blanket cylinder and an impression cylinder extending laterally within the press and arranged to apply wet ink to one side of a sheet moving downstream through the press, at least one of said sheet transfer means including a transfer conveyor having means for gripping and pulling a freshly printed sheet from the impression cylinder and moving said sheet downstream along said transfer path to the next processing station of the press, a vacuum transfer apparatus comprising:

a frame having leading and trailing end walls and laterally spaced side walls interconnected with a rear wall to define an upwardly open sided vacuum chamber, and including means defining an initial chamber portion and a final chamber portion, said frame being disposed with said leading end wall positioned closely adjacent said impression cylinder and extending laterally across a portion of said transfer path below said transfer conveyor;

a plurality of elongated generally cylindrical support rollers mounted to said frame side walls in closely spaced side-by-side parallel relation to extend laterally over said upwardly open side of said vacuum chamber and across said transfer path, the spaces between adjacent rollers defining elongated air inlet spaces through which air can flow into said vacuum chamber, said rollers each being mounted for rotation about its respective longitudinal axis;

means communicating with said vacuum chamber for producing a negative pressure within said chamber to draw air around said rollers through said air inlet spaces into said chamber thereby to draw the unprinted side of a freshly printed sheet into engagement with said support rollers as said sheet is pulled from said impression cylinder and moved along said transfer path by said transfer conveyor; and means for providing a substantially greater volume of air flow into said initial chamber portion than the air flow into said final chamber portion to draw said sheet more firmly into engagement with said rollers overlying said initial chamber portion than into engagement with said rollers overlying said final chamber portion.

19. A vacuum transfer apparatus as set forth in claim 18 wherein said means for providing said greater air flow includes providing a substantially greater inlet spacing between said support rollers overlying said initial chamber portion of said vacuum chamber than the inlet spacing defined between the support rollers overlying said final chamber portion.

20. A vacuum transfer apparatus as set forth in claim 19 wherein said support rollers overlying said initial vacuum chamber portion have annular recesses spaced along their length to form said greater spacing.

21. A vacuum transfer apparatus as set forth in claim 20 wherein said support rollers overlying said initial vacuum chamber portion have a diameter greater than said support rollers overlying said final vacuum chamber portion.

22. A vacuum transfer apparatus as set forth in claim 21 wherein said recesses are dimensioned to produce approximately twice the air flow into said initial vacuum chamber portion than that into said final vacuum chamber portion.

23. A vacuum transfer apparatus as set forth in claim 22 wherein the minimum spacing between each of said plurality of support rollers is approximately 1/16 inch.

24. A vacuum transfer apparatus as set forth in claim 23 wherein said means for creating said negative pressure includes a vacuum producing pump coupled in flow communication with said vacuum chamber.

25. A vacuum transfer apparatus as set forth in claim 23 wherein each of said support rollers is mounted to said frame for free rotation about its longitudinal axis.

26. A vacuum transfer apparatus as set forth in claim 21 wherein each of said support rollers is mounted to each of said side walls by a sealed bearing and axle.

27. A vacuum transfer apparatus as set forth in claim 26 wherein said recesses in said large diameter support rollers are spaced to permit the transfer conveyor gripping means to pass freely over said rollers.

28. A method of supporting a freshly printed sheet during a downstream transfer of the sheet from an impression cylinder of a sheet fed rotary printing press to a further downstream processing station of the press comprising the steps of:

gripping the leading edge of the freshly printed sheet as it emerges from the impression cylinder and pulling the sheet therefrom;

conveying the freshly printed sheet downstream along a transfer path such that the unprinted side of the sheet passes over a vacuum chamber having a plurality of rotatable support rollers disposed laterally across the transfer path in overlying relation with said chamber and arrayed in closely spaced side-by-side relation;

applying a negative pressure to the vacuum chamber to produce a flow of air into the chamber around the support rollers to draw the sheet into engagement with the support rollers as the sheet is conveyed downstream over the vacuum chamber; and creating a substantially greater flow of air into the chamber around the support rollers overlying an upstream portion of the chamber than the flow of air around the rollers overlying the portion of the chamber downstream of the upstream portion, whereby the unprinted side of the sheet is drawn more firmly into engagement with the support rollers overlying the upstream chamber portion than into engagement with the support rollers overlying the portion of the chamber downstream of the upstream portion as the sheet is conveyed along the transfer path.

29. The method as set forth in claim 28 wherein said greater flow of air is created by drawing a larger volume of air around the support rollers overlying said upstream chamber portion of the vacuum chamber than that drawn around the support rollers overlying the portion of the chamber downstream of the upstream portion.

* * * * *